US012383779B2

(12) United States Patent
Kwak et al.

(10) Patent No.: US 12,383,779 B2
(45) Date of Patent: Aug. 12, 2025

(54) WEIGHT GENERATION DEVICE FOR MUSCULAR-STRENGTH EXERCISE

(71) Applicants: Tae Young Kwak, Daejeon (KR); Sung Bo Shim, Daejeon (KR); Dong Chul Kwak, Daegu (KR)

(72) Inventors: Tae Young Kwak, Daejeon (KR); Sung Bo Shim, Daejeon (KR); Dong Chul Kwak, Daegu (KR)

( * ) Notice: Subject to any disclaimer, the term of this patent is extended or adjusted under 35 U.S.C. 154(b) by 64 days.

(21) Appl. No.: 18/579,481

(22) PCT Filed: Jun. 14, 2022

(86) PCT No.: PCT/KR2022/008374
§ 371 (c)(1),
(2) Date: Jan. 15, 2024

(87) PCT Pub. No.: WO2023/287028
PCT Pub. Date: Jan. 19, 2023

(65) Prior Publication Data

US 2024/0316383 A1 Sep. 26, 2024

(30) Foreign Application Priority Data

Jul. 16, 2021 (KR) ..... 10-2021-0093485

(51) Int. Cl.
*A63B 21/008* (2006.01)
*A63B 21/00* (2006.01)

(52) U.S. Cl.
CPC .... *A63B 21/0087* (2013.01); *A63B 21/00069* (2013.01)

(58) Field of Classification Search
CPC ..... A63B 21/0087; A63B 21/00069; A63B 21/4045; A63B 23/02; A63B 23/0405;
(Continued)

(56) References Cited

U.S. PATENT DOCUMENTS 767,008 A * 8/1904 Pelletier ..... A63B 21/0004 482/112
3,471,145 A * 10/1969 Berger ..... A63B 21/00072 482/112
(Continued)

FOREIGN PATENT DOCUMENTS

JP 3746390 B2 2/2006
JP 3211954 U 8/2017
(Continued)

OTHER PUBLICATIONS

ISA Korean Intellectual Property Office, International Search Report Issued in Application No. PCT/KR2022/008374, Sep. 26, 2022, WIPO, 6 pages.

*Primary Examiner* — Andrew S Lo
(74) *Attorney, Agent, or Firm* — McCoy Russell LLP

(57) ABSTRACT

The present invention relates to a weight generation device for muscular-strength exercise, the device generating weight with vacuum pressure through the adjustment of levers and valves since adjusting weight by moving heavy weights used for exercise equipment is conventionally inconvenient. The present invention relates to the weight generation device which allows a first cylinder, that is coupled to exercise equipment so as to vertically move, to be connected to a second cylinder through an air hose, and which allows the weight generated through the adjustment of the inner volume of the first cylinder, the air hose and the second cylinder to be easily adjusted. In addition, presented is folding exercise equipment which can be applied to frames of various conventional exercise equipment, and which is applied to folding exercise equipment so as to be easily moved and stored indoors.

9 Claims, 17 Drawing Sheets

(58) Field of Classification Search
CPC ..... A63B 23/1209; A63B 24/0087; A63B 2071/027; A63B 2210/50; A63B 21/062; A63B 21/078; A63B 21/4035; A63B 21/008
See application file for complete search history.

(56) References Cited

U.S. PATENT DOCUMENTS 3,836,141 A * 9/1974 Franklyn ..... A63B 21/0085 482/112
4,653,618 A 3/1987 Churchill et al.
4,865,317 A * 9/1989 Hickey ..... A63B 21/05 482/126
5,529,559 A * 6/1996 Punzalan ..... A63B 21/4045 482/111
5,735,780 A * 4/1998 Fazio ..... A63B 23/03525 482/112
7,163,495 B2 * 1/2007 Fazio ..... A63B 21/4045 482/111
7,896,785 B1 * 3/2011 Marcus ..... A63B 21/4015 482/111
8,007,418 B2 * 8/2011 LeVert ..... A63B 21/00072 482/112
8,419,600 B1 * 4/2013 Danowski ..... A63B 21/00061 482/112
11,612,777 B2 * 3/2023 Clarke ..... A63B 21/00192 482/139
2010/0292053 A1 * 11/2010 LeVert ..... A63B 21/0083 482/112
2019/0195350 A1 6/2019 Leiber et al.
2019/0247269 A1 8/2019 Devanaboyina
2020/0353301 A1 11/2020 McCann

FOREIGN PATENT DOCUMENTS

KR 100979631 B1 9/2010
KR 20100126160 A 12/2010
KR 20110079477 A 7/2011
KR 101747070 B1 6/2017
KR 20180066235 A 6/2018
KR 102401395 B1 5/2022
KR 102401403 B1 5/2022

* cited by examiner (a) (b)

WEIGHT GENERATION DEVICE FOR MUSCULAR-STRENGTH EXERCISE

CROSS REFERENCE TO RELATED APPLICATIONS

The present application is a U.S. National Phase of International Application No. PCT/KR2022/008374 entitled "WEIGHT GENERATION DEVICE FOR MUSCULAR-STRENGTH EXERCISE," and filed on Jun. 14, 2022. International Application No. PCT/KR2022/008374 claims priority to Republic of Korea Patent Application No. 10-2021-0093485 filed on Jul. 16, 2021. The entire contents of each of the above-listed applications are hereby incorporated by reference for all purposes.

TECHNICAL FIELD

The present invention relates to a weight generation device for muscular-strength exercise, and more particularly, to a device generating a desired weight by using a cylinder capable of generating vacuum pressure, instead of balance weights used in an existing muscular-strength exercise device, and changing the area and number of cylinders, the volume of an air chamber, an opening and closing area of a valve, and the like.

BACKGROUND AND SUMMARY

Exercise may be classified as aerobic exercise and muscular-strength exercise depending on the purpose and may be classified as outdoor exercise and indoor exercise depending on the location.

Outdoor aerobic exercise may be done simply by walking or running without any equipment, may use equipment, such as a bicycle. In the case of indoor aerobic exercise, equipment, such as a treadmill or an indoor bicycle is required, but these have already become widely popular.

In the case of muscular-strength exercise, there are ways to do muscular-strength exercise without tools both indoors and outdoors, such as push-ups, but in order to develop various muscles in the body, an indoor fitness center equipped with specialized equipment should be used. Even if these facilities are used, there are difficulties, such as the need for a professional trainer to be present at all times to help with exercise due to safety accidents and injuries. For this reason, it is difficult to install various muscular-strength exercise devices in public facilities, such as parks, trails, and apartment complexes, and it is even more difficult to install them at homes due to safety and space constraints.

As the 'stay-at-home' lifestyle continues due to the prolonged COVID-19 pandemic, the so-called 'home workout people' have emerged as a trend. As a result, sales of simple exercise devices, such as yoga mats, stretching bands, Swiss balls, and dumbbells, as well as professional exercise devices allowing for weight training, such as foam rollers, bench presses, and door frame bars, have also increased rapidly. Sales of indoor sports equipment increased by 50% and 43% in January and February 2017, respectively, compared to the same period last year, and this phenomenon is also clearly visible through social media. Compared to the number of posts mentioning 'gym' on social media over the past two years, the increase in home training is confirmed to be significantly higher, and home workout people share a so-called 'body profile', which records their exercise volume and saves body changes as photos, in real time through various channels, such as SNS, blogs, clubs, and Twitter.

However, while home training has recently become popular, various safety accidents have occurred, so caution is required. The Korea Consumer Agency reported a total of 207 hazardous accidents related to home training reported to the Consumer Injury Surveillance System (CISS) over the past three years (2016 to 2018), with more than 60 reported annually, and as a result of analyzing the causes of accidents by equipment, accidents due to falling from indoor bicycles were 28.3% and accidents caused by impact from dumbbells, etc. were the highest at 65.2%.

Therefore, for consumers who cannot use existing exercise devices due to safety and inconvenience, there is a need for a weight generation device capable of eliminating the risk of heavy objects and the inconvenience of weight adjustment by minimizing the shortcomings of all muscular-strength exercise devices sold on the market.

DISCLOSURE

Technical Problem

An object of the present invention is to provide a weight generation device for muscular-strength exercise capable of adjusting weight by operating a valve and lever instead of moving a heavy balance weight.

Another object of the present invention is to provide a weight generation device for muscular-strength exercise capable of generating weight in the same size and direction when a user applies force and when the user returns using vacuum pressure.

Another object of the present invention is to provide a weight generation device for muscular-strength exercise equipped with a safe vacuum pressure system to prevent injuries from falling and exercise.

Another object of the present invention is to provide a weight generation device for muscular-strength exercise capable of reducing volume and weight for easy movement and storage indoors.

Technical Solution

In one general aspect, a weight generation device includes: a first piston moving up and down by an external force and having an upper end including a coupling portion coupled to an exercise device; a first cylinder formed between the first piston and a first bottom surface and including a first suction chamber in which vacuum pressure is formed by pulling the first piston; a second cylinder including a second suction chamber formed between a second piston and a second bottom surface; an air hose disposed to connect the first suction chamber and the second suction chamber; a weight adjusting unit controlling a position of the second piston; and a housing including the second cylinder and the weight adjusting unit, wherein a generated weight is adjusted by adjusting a volume of the second suction chamber by changing a position of the second piston by the weight adjusting unit.

In addition, the weight adjusting unit may include: a connection portion coupled to upper ends of one or more second pistons; a rotating shaft having one end disposed through a center of the connection portion in a height direction and the other end disposed through the housing and having a thread formed on an outer surface thereof; a lever coupled to the other end of the rotating shaft; and a fixing member penetratingly coupled to the rotating shaft and disposed at a lower end of the connection portion.

In addition, a plurality of first cylinders and one or a plurality of second cylinder may be connected.

In addition, one or a plurality of first cylinder and a plurality of second cylinders may be connected.

In addition, the air hoses may be spaced apart from each other at a certain interval on an outer surface of the second cylinder in a height direction and connected to the second suction chamber and each of the air hoses may include an adjustment valve that turns on/off or proportional control.

In addition, an outer surface of the first cylinder and an outer surface of the second cylinder may be coupled, and the first suction chamber and the second suction chamber may be connected.

In addition, the first cylinder may be disposed inside the second cylinder and connects the first suction chamber and the second suction chamber.

In another general aspect, a weight generation device includes: a first piston moving up and down by an external force and having an upper end including a coupling portion coupled to an exercise device; a first cylinder formed between the first piston and a first bottom surface and including a first suction chamber in which vacuum pressure is formed by pulling the first piston; and a chamber block formed with a hole in which the first cylinder is located in a center, wherein the chamber block includes a first chamber block including a control valve and a second chamber block including a second suction chamber, and the first chamber block and the second chamber block are alternately stacked.

In addition, the first cylinder may be connected to the chamber block disposed at a lowermost end.

In addition, the first chamber block may be connected to the second chamber block in contact with upper and lower surfaces, so that a generated weight may be adjusted by adjusting a volume of the second suction chamber.

Advantageous Effects

The present invention has the effect of adjusting the weight by operating a valve and a lever instead of moving a heavy balance weight.

In addition, weight is generated in the same direction when the user applies force and when returns using vacuum pressure.

In addition, a safe pneumatic system is provided to prevent injuries from falling and exercise.

In addition, the volume and weight may be reduced to facilitate movement and storage indoors.

DETAILED DESCRIPTION

Conventional exercise devices involve exercising by applying force by hanging balance weights, so not only may the balance weights break away and fall, or accidents may occur during the process of moving the balance weights, but even experts who are familiar with using the equipment may be injured at any time if they are careless even for a moment, and there are space limitations because various balance weights should be provided.

The present invention uses the principle of generating weight using vacuum pressure instead of a balance weight, thereby solving the problem of the balance weight falling off during exercise, preventing injuries that occur due to a sudden fall of balance weights, etc., due to carelessness, decreased muscular endurance, etc. because air pressure has a shock absorbing function, and allowing users to do muscular-strength exercises with various weights and types even in a narrow space by replacing various balance weights just with adjustment of a lever and a valve.

Hereinafter, the weight generation device for muscular-strength exercise according to the present invention having the configuration described will be described in detail with reference to the attached drawings.

[1] Overall Configuration and Operating Principle of the Present Invention

Figure 1:
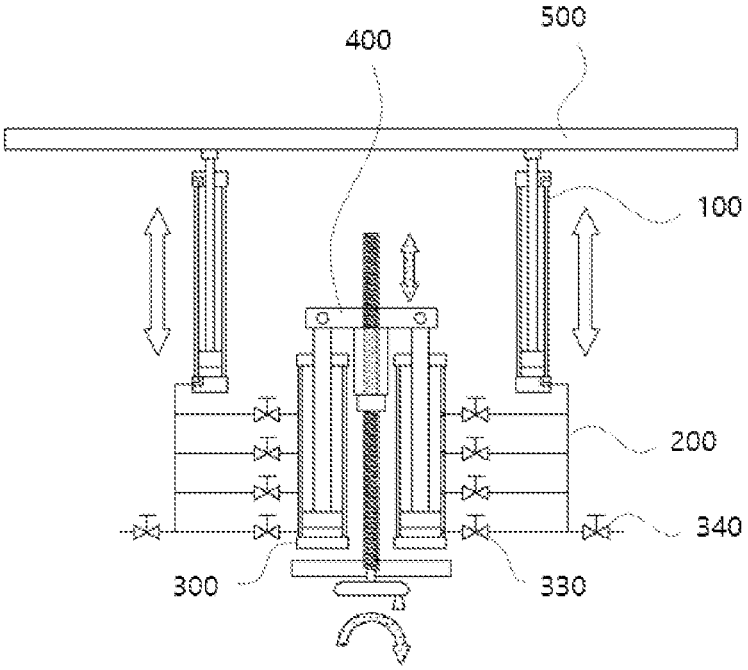
FIG. 1 is a schematic diagram of the present invention.

FIG. 1 is a schematic diagram of the present invention. Referring to FIG. 1, an exercise device 500 is coupled to an upper end of a first cylinder 100, and the first cylinder 100 makes a piston movement in a vertical direction by an external force. A lower end of the first cylinder 100 is connected to one end of an air hose 200, and the other end of the air hose 200 is connected to a lower end of the second cylinder 300. The air hose 200 to which the first cylinder 100 and the second cylinder 300 are connected is connected to a control valve 330 for ON/OFF or proportional control of connection and an exhaust valve 340 for ON/OFF connection with the outside. A position of a piston located within the second cylinder 300 is adjusted by a weight adjusting unit 400. The position of the weight adjusting unit 400 is adjusted by a lever located at a lower end, and weight generated by adjusting an internal volume of the second cylinder 300 is adjusted.

At this time, the generated weight is generated in a downward direction of the first cylinder 100, and the weight is generated in the same direction when the user pushes and pulls the exercise device 500.

Figure 2:
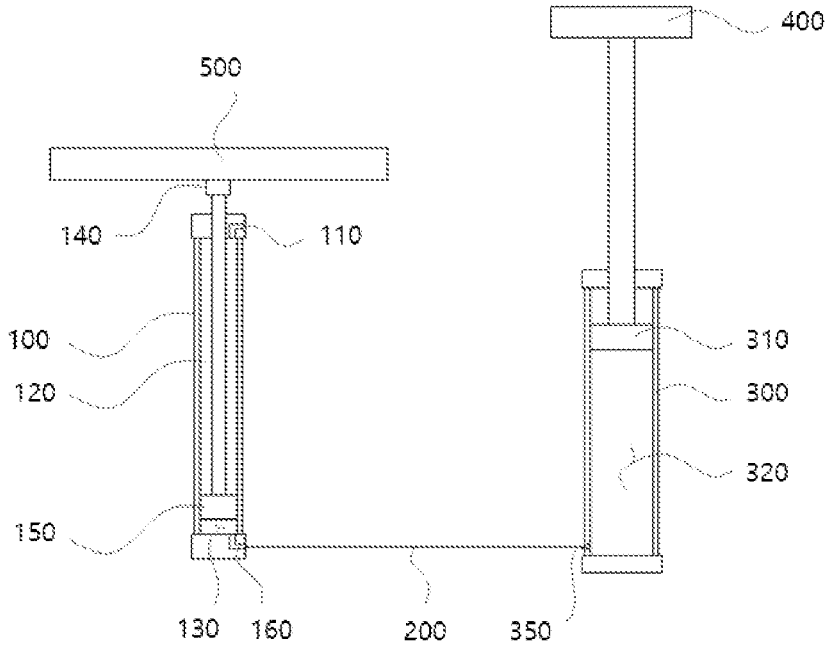
FIG. 2 is a conceptual diagram of the present invention.

FIG. 2 is a conceptual diagram of the present invention. Referring to FIG. 2, the first cylinder 100 includes a first piston 150 moving up and down therein by an external force, and an upper end of the first piston 150 is coupled to a coupling portion 140 coupled to the exercise device 500. The first cylinder 100 includes a discharge portion 110 in communication with external air disposed at an upper end thereof, and when a space between an upper surface of the first piston 150 and the discharge portion 110 is referred to as a discharge chamber 120, the discharge chamber 120 is connected to external air and maintains atmospheric pressure at all times, and when the first piston 150 moves up and down, air is introduced or discharged.

When a space between a lower surface of the first piston 150 and a bottom surface of the first cylinder 100 is referred to as a first suction chamber 130, the first suction chamber 130 is blocked from the discharge chamber 120. The first suction chamber 130 is connected to the outside by a first connection portion 160 formed on the bottom surface of the first cylinder 100 and is connected to the second cylinder 300 by the air hose 200 as shown.

The second cylinder 300 includes a second piston 310 moving up and down by an external force, and a discharge portion is provided at an upper end of the second cylinder 300, so that the second piston 310 moves up and down smoothly. The weight adjusting unit 400 is coupled to an upper end of the second piston 310 to adjust a position of the second piston 310. When a space between a lower surface of the second piston 310 and a second bottom surface of the second cylinder 300 is referred to as a second suction chamber 320, the second suction chamber 320 is connected to the first suction chamber 130 through a second connection portion 350 formed at a lower end thereof and the air hose 200. At this time, the second connection portion 350 may be formed through the bottom surface of the second cylinder 300 and connected to the air hose 200.

The spaces of the first suction chamber 130, the second suction chamber 320, and the air hose 200 are sealed, and the weight generated by the exercise device 500 changes according to the sum of their respective volumes.

Figure 3:
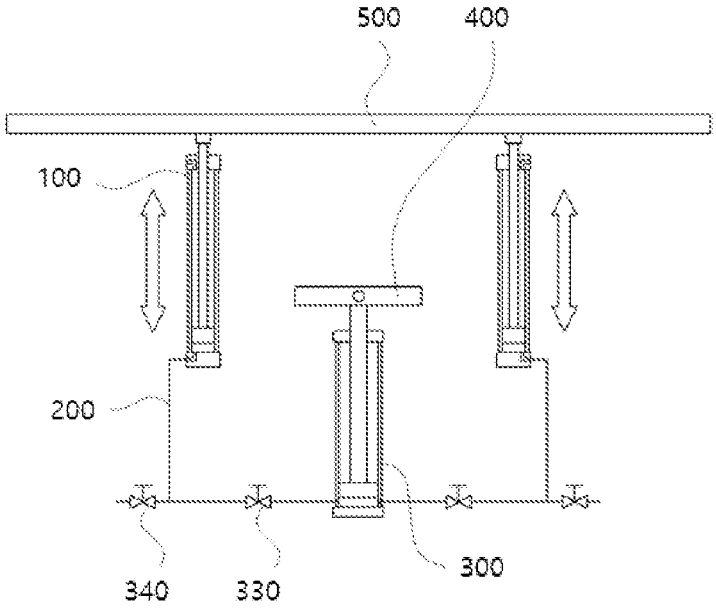
FIGS. 3 to 5 are diagrams of the present invention.
Figure 4:
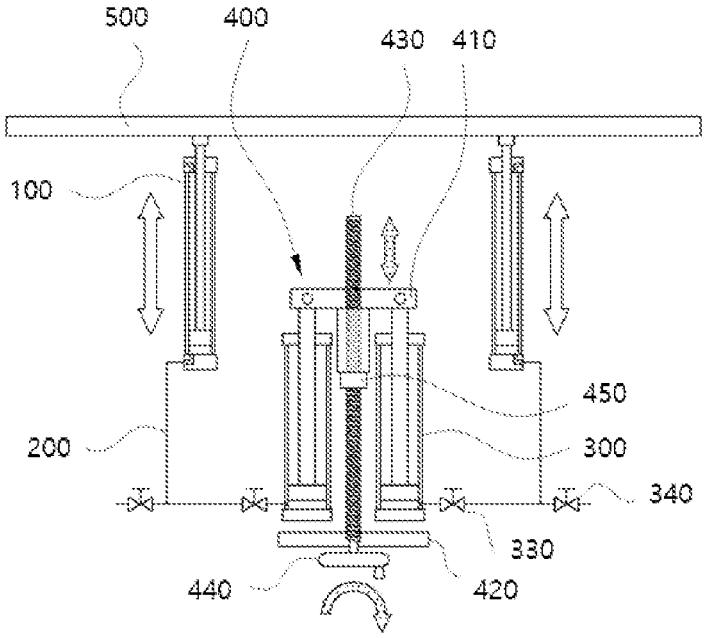
Figure 5:
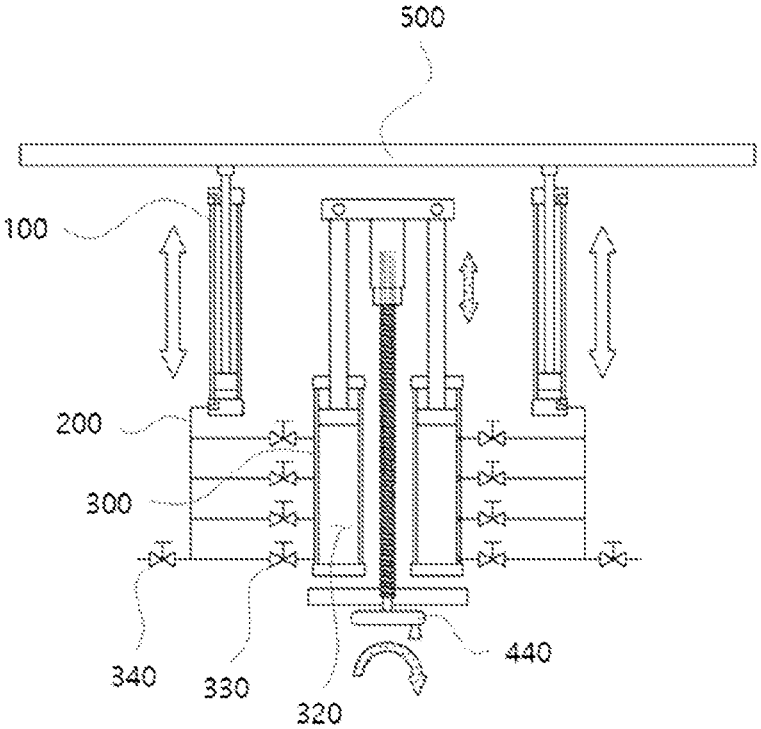

FIGS. 3 to 5 are diagrams of the present invention. Referring to FIG. 3, an example in which a plurality of first cylinders 100 are connected to one second cylinder 300 is illustrated. Upper ends of the plurality of first cylinders 100 are coupled to the exercise device 500 by coupling portions, and lower ends thereof includes a first connection portion to be connected to the second cylinder 300 through the air hose 200. A plurality of second connection portions are formed at the lower end of the second cylinder 300 in a circumferential direction and connected to the plurality of first cylinders 100, and when one first connection portion 160 is formed, a plurality of air hoses 200 are connected to each other and connected to the plurality of first cylinders 100.

At this time, the air hose 200 is connected to an exhaust valve 340 that opens and closes the connection with external air and a control valve 330 that blocks air into the second cylinder 300. Since the first suction chamber 130, the second suction chamber 320, and the air hose 200 are sealed spaces, after the control valve 330 and the exhaust valve 340 are opened, internal pressure is adjusted to atmospheric pressure by adjusting the weight. When the first cylinder 100 connected to one second cylinder 300 is increased, the air sucked from the second cylinder 300 increases compared to a stroke of the exercise device 500, so the weight generated in the first cylinder 100 increases. Conversely, as the number of second cylinders 300 connected to one first cylinder 100 increases, the generated weight decreases.

FIGS. 4 and 5 illustrate an example in which a plurality of first cylinders are connected to a plurality of second cylinders. Upper ends of the plurality of first cylinders 100 are coupled to the exercise device 500 by coupling portions, and lower ends thereof are formed with the first connection portion 160 to be connected to the plurality of second cylinders 300 through the air hose 200. The air hose 200 is connected to an exhaust valve 340 that opens and closes connection with external air and a control valve 330 that blocks air into the second cylinder 300.

Referring to FIG. 4, the upper ends of the plurality of second cylinders 300 are coupled with the weight adjusting unit 400, so that the plurality of second cylinders 300 are connected. The weight adjusting unit 400 includes a connection portion 410 coupled to the upper end of one or more second pistons 310, a rotating shaft 430 having one end disposed to penetrate through the center of the connection portion 410 in a height direction and the other end penetrating through the housing 420 and having a thread formed on an outer surface thereof, a lever 440 coupled to the other end of the rotating shaft 430, and a fixing member 450 penetratingly coupled to the rotating shaft and disposed at a lower end of the connection portion 410.

The connection portion 410 is connected to the upper ends of the plurality of second pistons 310 and simultaneously adjusts the positions of the plurality of second pistons 310, and the position is adjusted by the rotating shaft 430 on which the lever 440 is formed. In order to fix the position of the second piston 310, the fixing member 450 is coupled to the rotating shaft 430, and the fixing member 450 may be further formed outside the housing 420.

Referring to FIG. 5, an example showing a state in which the position of the second piston 310 moves due to rotation of the lever 440 and a volume of the second suction chamber 320 has increased is illustrated. The first cylinder 100 is connected to the exercise device 500 and connected to the air hose 200 by a first connection portion formed at a lower end thereof to be connected to the second cylinder 300.

At this time, a plurality of air hoses 200 may be connected to the second cylinder 300 in the height direction or circumferential direction. Each air hose 200 may be connected to the control valve 330 or may be connected to the first cylinder 100 and a cylinder having a certain space. This is to adjust the generated weight by increasing or decreasing the volume of the closed space. The exhaust valve 340 is adjusted first when adjusting the weight, and the pressure in the closed space before the vertical movement of the exercise device 500 is maintained at atmospheric pressure.

Figure 6:
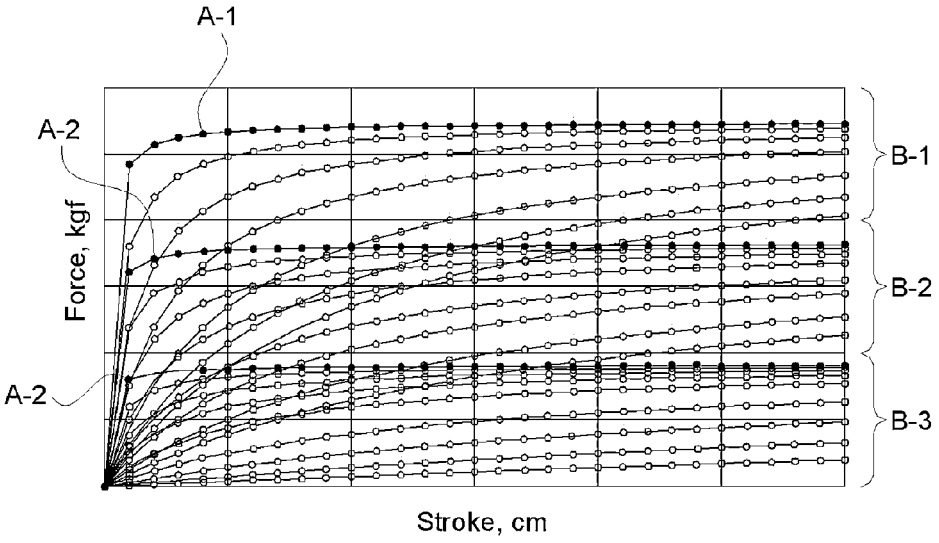
FIG. 6 is a stroke-weight graph of the present invention.

FIG. 6 is a stroke-weight graph. Referring to FIG. 6, in the present invention, it can be seen that the weight generated after a certain stroke becomes constant. Therefore, it shows that the present invention may sufficiently replace existing balance weights. A is a graph showing a weight change according to the number of first cylinders, and B is a graph showing a weight change according to the volume of the second suction chamber in the second cylinder. All initial values are equal to atmospheric pressure.

In the case A, the generated weight may be rapidly changed by changing the number of first cylinders and may be applied separately by experts and the general public depending on the number of first cylinders. B-1 may be an example to which one first cylinder is applied, B-2 may be an example to which two first cylinders are applied, and B-3 may be an example to which three first cylinders are applied.

The weight of B is changed depending on the position of the second piston. In the case of the weight using existing balance weights, the weight generated by a determined balance weight is adjusted, but in the present invention, the weight is generated according to the position of the second piston and the volume of the closed space, so the weight may be adjusted in smaller units than the existing balance weights.

Figure 7:
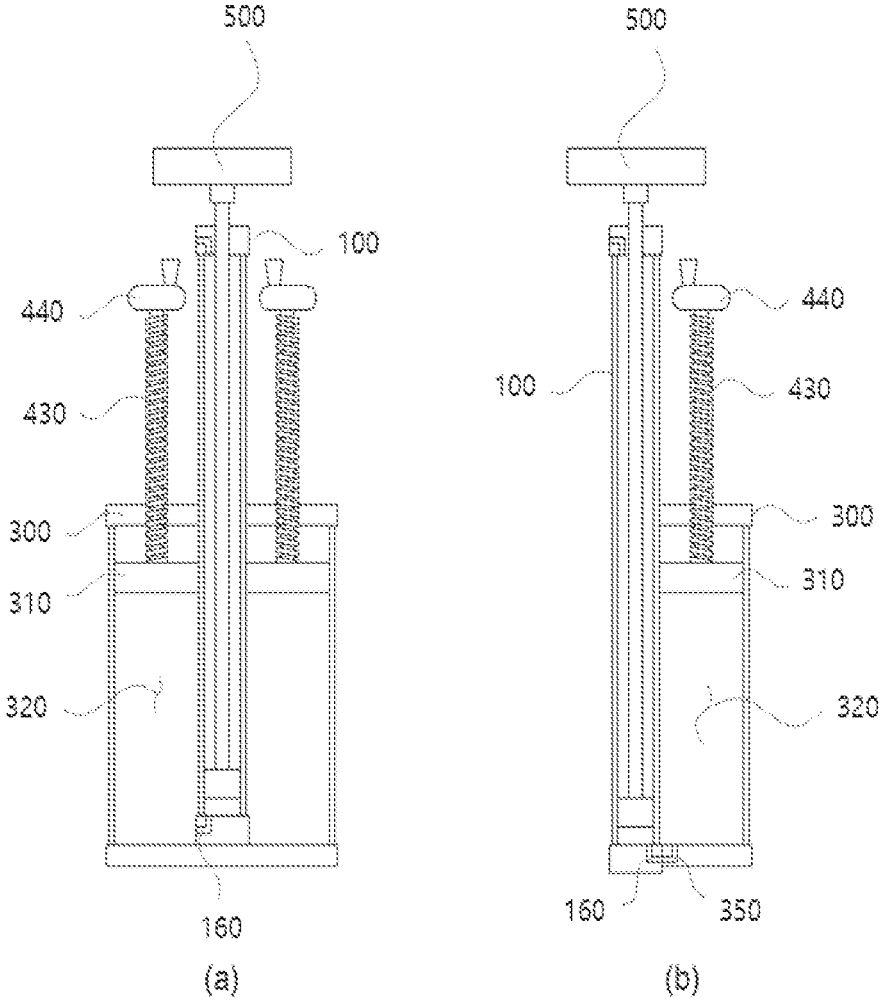
FIGS. 7 and 8 are modified examples of the present invention.

FIG. 7 is a modified example of the present invention. The first cylinder 100 and the second cylinder 300 of the present invention may be integrated or combined. Referring to FIG. 7A, the exercise device 500 is coupled to the upper end of the first piston 150, and the first piston 150 is inserted into the second piston 310 to make a piston movement. The discharge portion of the first cylinder 100 is outside, so there is no problem in the vertical movement, and the first piston 150 included in the second piston 310 has the first connection portion 160 at the lower end, so the first suction chamber 130 and the second suction chamber 320 are connected. In addition, the lever 440 for adjusting the generated weight is disposed to adjust the position of the second piston 310. The position of the lever 440 is not limited to the upper end of the second cylinder 300, and the lever 440 may be disposed at the side or lower end to adjust the volume of the second suction chamber 320 therein.

FIG. 7B is an example in which the second cylinder 300 is coupled to the outer surface of the first cylinder 100. A first connector formed on a bottom surface of the first cylinder 100 and a second connector formed on a bottom surface of the second cylinder 300 are directly connected. A weight generation device 1000 may be compactly configured by directly coupling the first cylinder 100 and the second cylinder 300. The first cylinder 100 has a plurality of first connection portions 160 formed in the circumferential direction, so that a plurality of second cylinders 300 may be combined, thereby adjusting the generated weight. In addition, a plurality of second connection portions 350 may be formed to enable coupling between the second cylinders 300 to adjust a generated weight.

In addition, the second cylinder 300 may be coupled to the lower end of the first cylinder 100, and may be modified into various embodiments using the air hose 200.

Figure 8:
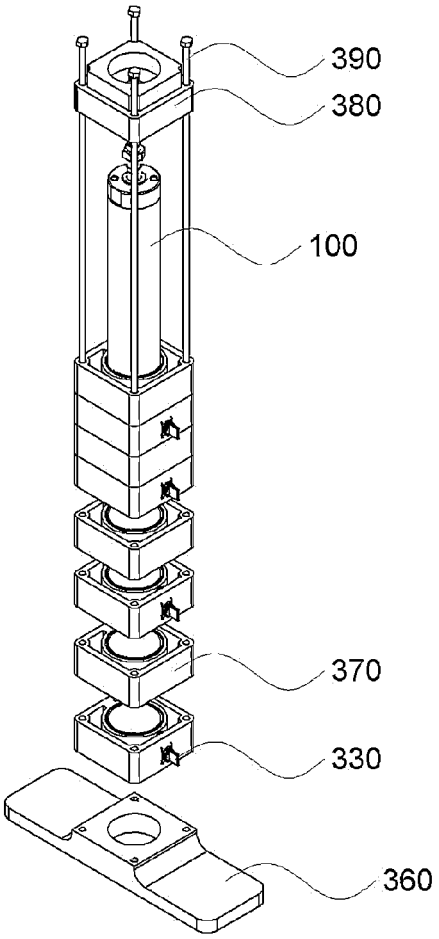

FIG. 8 is a modified example of the weight generation device. A lower end is a base 360 that supports the weight generation device, and a plurality of chamber blocks 370 are stacked at an upper end of the base 360. The first cylinder 100 is inserted into the center of the chamber block 370, and a cylinder cover 380 is disposed at the upper end of the chamber block 370. The sequentially stacked base 360, chamber block 370, and cylinder cover 380 are fixed by a plurality of fastening members 390 in a stacking direction.

The chamber block 370 is divided into a first block including the control valve 330 and a second block including the second suction chamber and is sequentially stacked so that the control valves 330 of the first block connects the second suction chamber of the second block located at the upper and lower ends. The generated weight may be easily adjusted by adjusting the control valve 330 from the lower end.

The fastening member 390 has a shape of a long bolt. An insertion hole into which the fastening member 390 is inserted is formed at the corners of the cylinder cover 380 and the chamber block 370, and a fastening hole is formed in the base 360 at a position corresponding to the insertion hole so that the fastening member 390 couples the configuration of the weight generation device.

Figure 9:
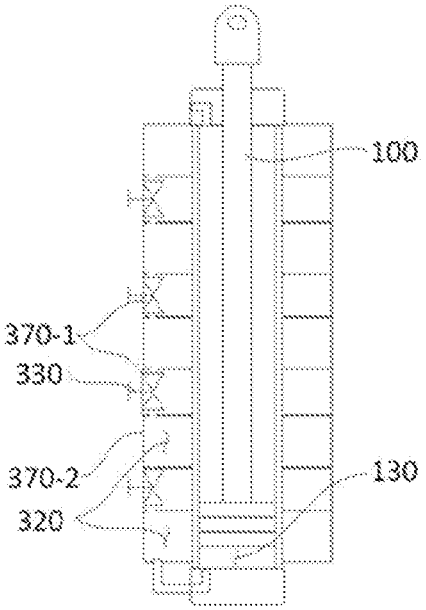
FIG. 9 is a conceptual diagram of FIG. 8.
Figure 10:
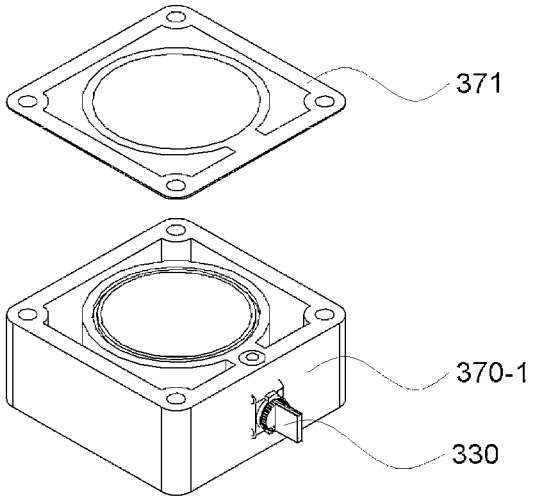
FIG. 10 is a configuration diagram of a first chamber block.

FIG. 9 is a conceptual diagram of FIG. 8, and FIG. 10 is a configuration diagram of the first chamber block. Referring to FIGS. 9 and 10, the chamber block 370 has a hole formed in the center into which the first cylinder 100 is inserted, and a hole into which the fastening member 390 is inserted is formed at the corner. In the case of a first chamber block 370-1, the control valve 330 is disposed on one side, and the control valve has a handle 521 that the user may operate on the outside of the first chamber block 370-1. A passage is formed inside the first chamber block 370-1 to connect the second chamber blocks 370-2 arranged above and below. The second chamber block 370-2 has the same external appearance as the first chamber block 370-1, but a space corresponding to the second suction chamber 320 is formed therein, and a hole is formed at a position corresponding to the control valve 330 formed in the first chamber block 370-1. A gasket 371 is inserted between the chamber blocks 370 to prevent external air inflow and internal air outflow.

The first chamber block 370-1 may have a space formed therein to form a second suction chamber, and the second suction chamber in the first chamber block 370-1 may be utilized by changing the type and shape of the control valve 330.

As described above, by presenting the weight generation device using a plurality of chamber blocks connected to the first cylinder, the generated weight may be easily controlled by the plurality of chamber blocks and the control valve.

[2] Exercise Device Using the Present Invention

Figure 11:
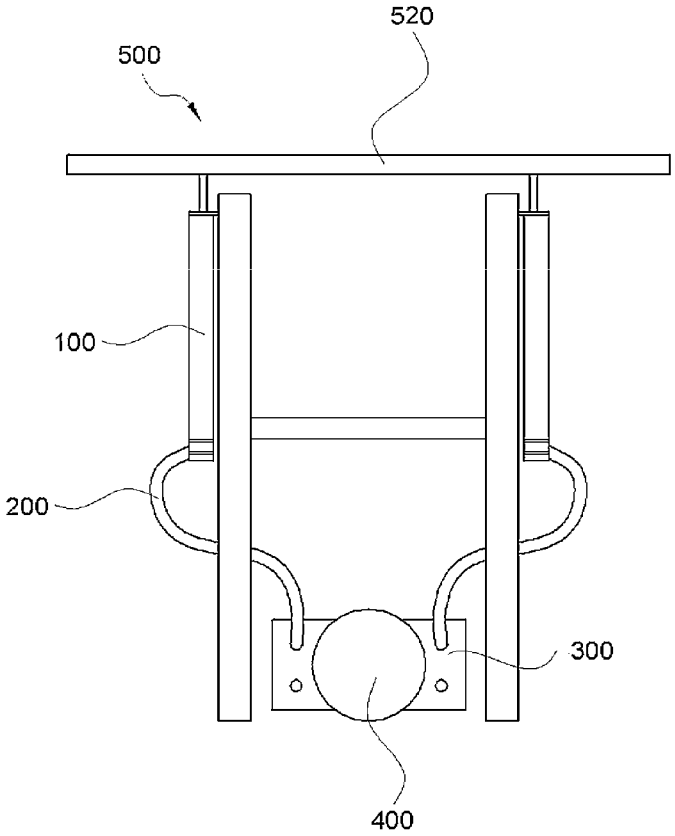
FIG. 11 is a diagram illustrating an exercise device to which the present invention is applied.

FIG. 11 is a configuration diagram in which a weight generation device is disposed outside an exercise device. Referring to FIG. 11, the first cylinder 100 is disposed outside a pillar of the exercise device 500, and the weight adjusting unit 400 and the second cylinder 300 are disposed at a lower end of a bench. The exercise device 500 is moved up and down by an external force of a load bar 520 coupled to an upper end of the first cylinder 100, and the first cylinder 100 and the second cylinder 300 are connected by the air hose 200.

At this time, the first cylinder 100 is coupled to a frame that does not move, and a device that is moved in the vertical direction is connected to the coupling portion 140. The weight adjusting unit 400 is located at the lower end of the bench or coupled to a non-moving frame.

A stroke length moved by the exercise device 500 may be changed in design depending on a length of the first cylinder 100, and the weight may be easily adjusted by providing a plurality of second cylinders 300.

The present invention may be combined with an exercise device used in actual gyms, which not only prevents safety accidents and injuries, but also reduces equipment costs, and facilitates disassembly, assembly, and transportation.

In addition, since an initial pressure value of the present invention is the same as atmospheric pressure, noise and safety accidents that occur when the exercise bar is suddenly put down or lost during exercise may be prevented.

The exercise device may be linked to an application to check the amount of exercise according to an exercise method, and the application may set a warm-up stage to design a safety system to relieve tension and warm up the body through light weights before a weight exercise.

[3] Foldable Exercise Device Using the Present Invention

Figure 12:
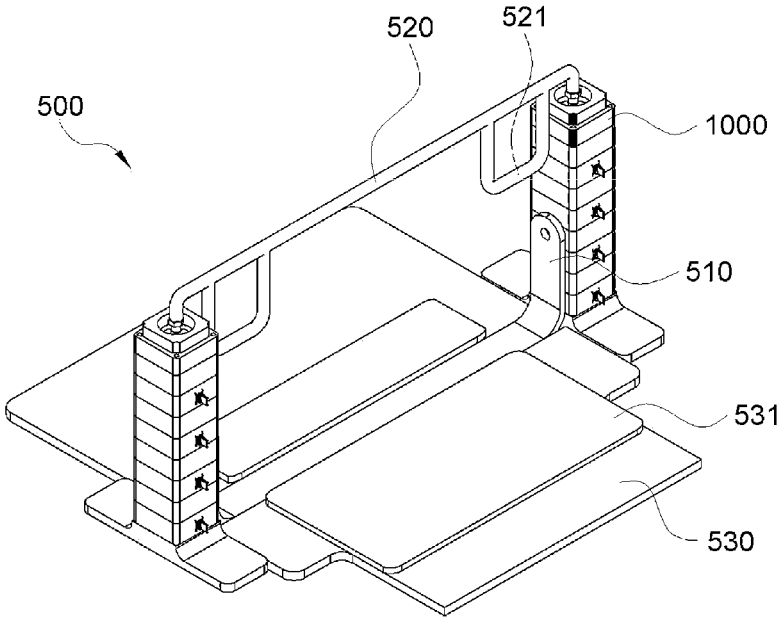
FIGS. 12 to 17 are diagrams illustrating of a foldable exercise device to which the present invention is applied.

FIGS. 12 to 17 are drawings illustrating a multi-press using the above weight generation device. In the description below, a foldable type exercise device for use at home, to which the weight generation device of FIG. 8 is applied, is proposed. Referring to FIG. 12, the weight generation devices 1000 are disposed, and a frame 510 is disposed in between to adjust and fix an interval of the weight generation devices 1000. A support plate 530 is disposed at the front and rear of the frame 510, and a mat 531 is disposed on an upper surface of the support plate. The weight generation devices 1000 disposed at both ends have a load bar 520 disposed at an upper end and move in the vertical direction, and the load bar 520 may have a handle 521 disposed so that a user's grip position may be changed.

Figure 13:
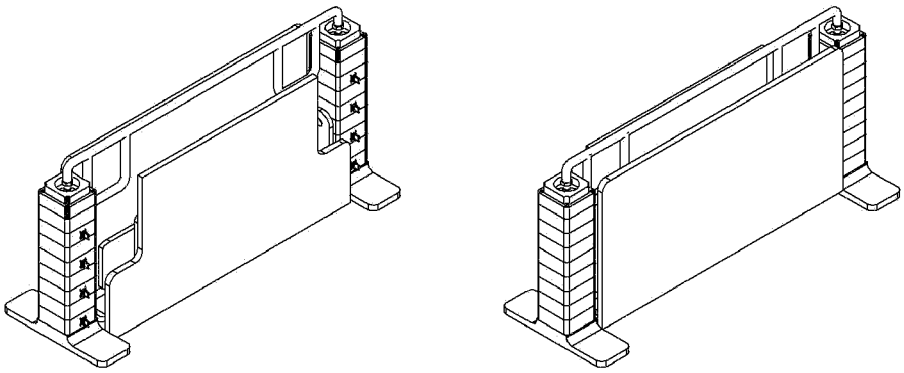

Referring to FIG. 13, the support plate 530 and the mat 531 disposed at the front and rear of the support plate 530 may be arranged vertically and may be easily stored. FIG. 13(*a*) is a front perspective view, and FIG. 13(*b*) is a rear perspective view. The support plate disposed at the front may be smaller than the support plate disposed at the rear, and, if necessary, the frame and the support plate may be coupled with a hinge and moved, or the base and the support plate may be coupled and moved.

Figure 14:
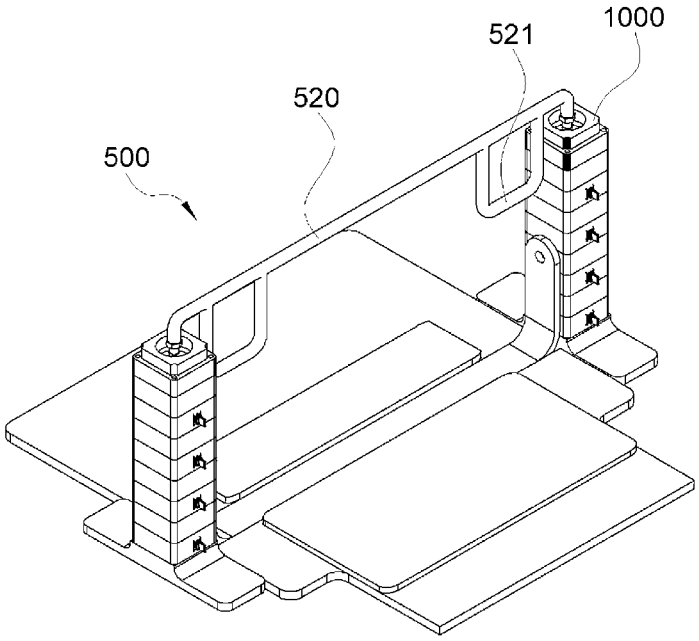
Figure 15:
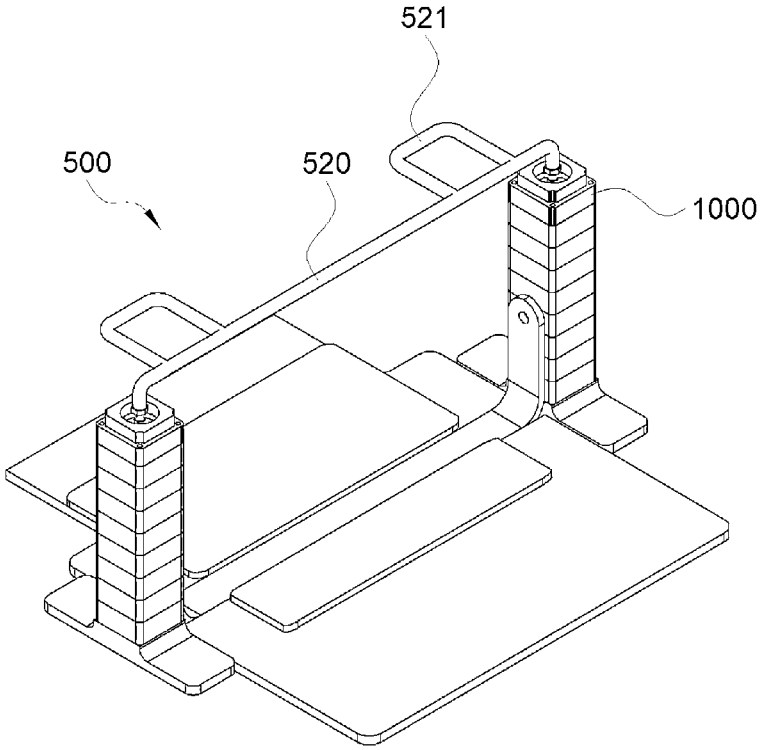
Figure 16:
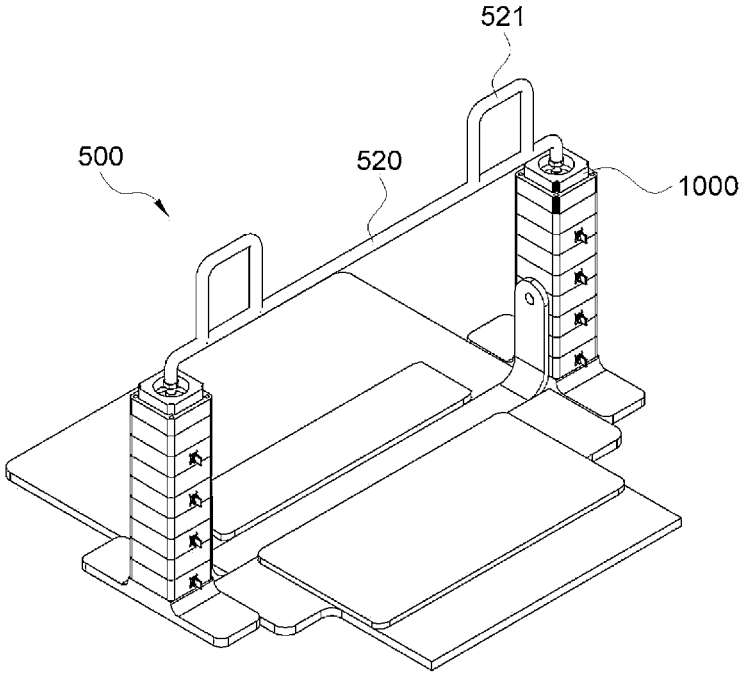

FIGS. 14 to 16 are examples of exercise methods according to a direction of the handle 521. As shown in the drawing, the handle 521 located on the load bar 520 may be changed according to the user's desired grip position. Referring to FIG. 14, an example of a bench press mode in which the handle 521 is disposed below the load bar 520 and the user exercises by pushing up in the vertical direction from below is illustrated. Referring to FIG. 15, an example of a leg press mode in which the handle 521 is located on the load bar 520 toward the front or back and the user pushes up with strength of his or her legs to exercise is illustrated. An angle adjustment member may be disposed on the back of the support plate 530 with which the user's back is in contact, so that the angle may be adjusted, and the angle of the handle 521 may be changed. Referring to FIG. 16, an example of a deadlift mode in which the handle 521 is disposed above the load bar 520 and the user lifts it from above to exercise is illustrated. As presented above, various exercises may be done depending on the position of the handle 521.

The name of the mode above is an example and is not limited to the exercise.

Figure 17:
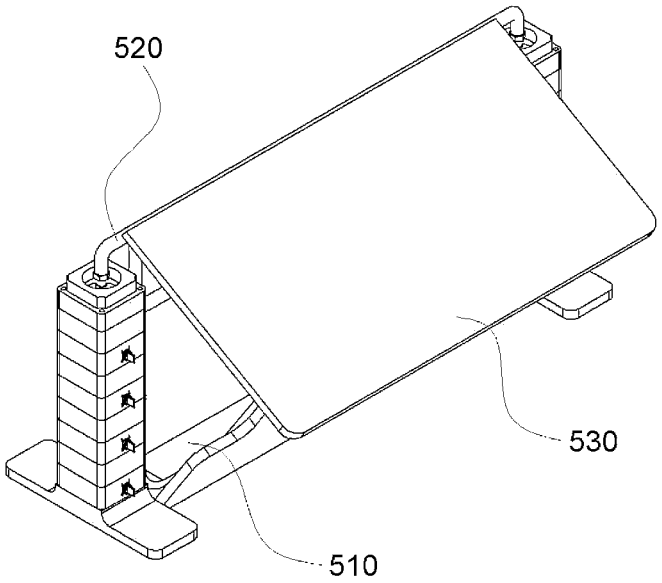

FIG. 17 is a modified example using the present invention. Referring to FIG. 17, a sitting angle-adjustable table by changing the position of the support plate 530 is illustrated. The support plate 530 may be coupled to the load bar 520 to be used as a table, and the table in which an angle is adjusted according to the position of the support plate 530 is proposed. This is a combination of the exercise device and furniture, and the exercise device may be transformed into a table, etc. and located indoors. Due to the above features aimed at home training, the utilization of the user's space may be increased, the cost burden may be reduced, and convenience and interior elements may be provided.

As the present invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention.

When an element is mentioned to be "coupled" or "connected" to another element, this may mean that it is directly coupled or connected to the other element, but it is to be understood that yet another element may exist in-between.

Unless otherwise defined, all terms used herein, including technical or scientific terms, have the same meanings as those generally understood by those with ordinary knowledge in the field of art to which the present invention belongs.

Such terms as those defined in a generally used dictionary are to be interpreted to have the meanings equal to the contextual meanings in the relevant field of art, and are not to be interpreted to have ideal or excessively formal meanings unless clearly defined in the present application.

The present invention should not be construed as being limited to the above-mentioned exemplary embodiment. The present invention may be applied to various fields and may be variously modified by those skilled in the art without departing from the scope of the present invention claimed in the claims.

DETAILED DESCRIPTION OF MAIN ELEMENTS

1000: weight generation device
100: first cylinder
110: discharge portion 120: discharge chamber 130: first suction chamber
140: coupling portion 150: first piston 160: first connection portion
200: air hose
300: second cylinder
310: second piston 320: second suction chamber 330: control valve
340: exhaust valve 350: second connection portion 360: base
370: chamber block
370-1: first chamber block 370-2: second chamber block
380: cylinder cover 390: fastening member
400: weight adjusting unit
410: connection portion 420: housing 430: rotating shaft
440: lever 450: fixing member
500: exercise device
510: frame 520: load bar 521: handle
530: support plate 531: mat

The invention claimed is:

1. A weight generation device comprising:
a first piston moving up and down by an external force and having an upper end including a coupling portion coupled to an exercise device;
a first cylinder formed between the first piston and a first bottom surface and including a first suction chamber in which vacuum pressure is formed by pulling the first piston;
a second cylinder including a second suction chamber formed between a second piston and a second bottom surface;
an air hose disposed to connect the first suction chamber and the second suction chamber;
a weight adjusting unit controlling a position of the second piston; and
a housing including the second cylinder and the weight adjusting unit,
wherein
the second cylinder is connected to the air hose in a longitudinal direction,
the air hose includes one or more control valves switched on or off and an exhaust valve connected to the outside,
a weight generated by pulling the first piston is adjusted by adjusting a volume of the second suction chamber by changing a position of the second piston by the weight adjusting unit, and
the position of the second piston changes in an atmospheric pressure state by opening the exhaust valve.

2. The weight generation device of claim 1, wherein
the weight adjusting unit includes:
a connection portion coupled to upper ends of one or more second pistons;
a rotating shaft having one end disposed through a center of the connection portion in a height direction and the other end disposed through the housing and having a thread formed on an outer surface thereof;
a lever coupled to the other end of the rotating shaft; and
a fixing member penetratingly coupled to the rotating shaft and disposed at a lower end of the connection portion.

3. The weight generation device of claim 1, wherein a plurality of first cylinders and one second cylinder are connected.

4. The weight generation device of claim 2, wherein one first cylinder and a plurality of second cylinders are connected.

5. The weight generation device of claim 1, wherein an outer surface of the first cylinder and an outer surface of the second cylinder are coupled, and the first suction chamber and the second suction chamber are connected.

6. The weight generation device of claim 1, wherein the first cylinder is disposed inside the second cylinder and connects the first suction chamber and the second suction chamber.

7. A weight generation device comprising:

a first piston moving up and down by an external force and having an upper end including a coupling portion coupled to an exercise device;

a first cylinder formed between the first piston and a first bottom surface and including a first suction chamber in which vacuum pressure is formed by pulling the first piston; and a chamber block formed with a hole in which the first cylinder is located in a center, wherein the chamber block includes a first chamber block including a control valve and a second chamber block including a second suction chamber, and the first chamber block and the second chamber block are alternately stacked.

8. The weight generation device of claim 7, wherein the first cylinder is connected to the chamber block disposed at a lowermost end.

9. The weight generation device of claim 7, wherein the first chamber block is connected to the second chamber block in contact with upper and lower surfaces, so that a generated weight is adjusted by adjusting a volume of the second suction chamber.

* * * * *